United States Patent [19]

Bamber

[11] Patent Number: 4,995,154

[45] Date of Patent: Feb. 26, 1991

[54] NESTING FLATWARE SET

[75] Inventor: David J. Bamber, Wichita, Kans.

[73] Assignee: Coleman Outdoor Products, Inc., Wichita, Kans.

[21] Appl. No.: 394,487

[22] Filed: Aug. 16, 1989

[51] Int. Cl.[5] ..... A47J 43/28; A47J 43/00

[52] U.S. Cl. ..... 30/147; 30/148

[58] Field of Search ..... 30/147, 148, 149, 150, 30/129, 137, 322, 340

[56] References Cited

U.S. PATENT DOCUMENTS

| | | | |
|---|---|---|---|
| 812,424 | 2/1906 | Hellmuth | 30/147 |
| 1,053,387 | 2/1913 | Hawley | 30/147 |
| 1,425,750 | 8/1922 | Crawford | 30/148 |
| 2,439,882 | 4/1948 | Beddow . | |
| 4,215,471 | 8/1980 | Schaefer | 30/147 |
| 4,377,035 | 3/1983 | Dalichow . | |
| 4,524,512 | 6/1985 | Formo . | |

FOREIGN PATENT DOCUMENTS

| | | | |
|---|---|---|---|
| 43508 | of 1910 | Austria | 30/147 |
| 2165 | 4/1890 | Sweden | 30/147 |

OTHER PUBLICATIONS

Photocopies of nesting flatware set.

*Primary Examiner*—Douglas D. Watts
*Assistant Examiner*—Paul M. Heyrana, Sr.

[57] ABSTRACT

A nesting flatware set includes a knife, a fork, and a spoon. The knife and fork each include top and bottom end portions and dovetail locking portions which interfit to frictionally lock the knife and fork together. The spoon includes a bowl, a handle, and a pair of locking shoulders at the bottom end of the handle. The top and bottom end portions of the knife and fork are angularly related, and the knife and fork are frictionally locked against the spoon by inserting their bottom ends between the locking shoulders and the handle of the spoon so that the top ends of the knife and fork resiliently bear against the bowl of the spoon.

11 Claims, 1 Drawing Sheet

FIG. 1
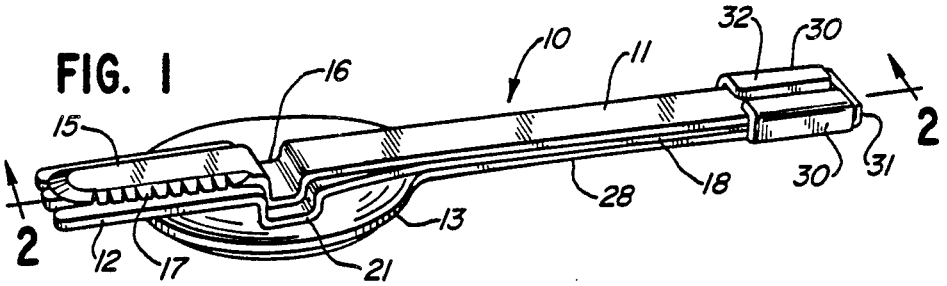
FIG. 2
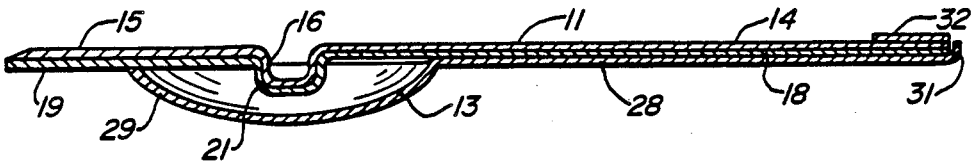
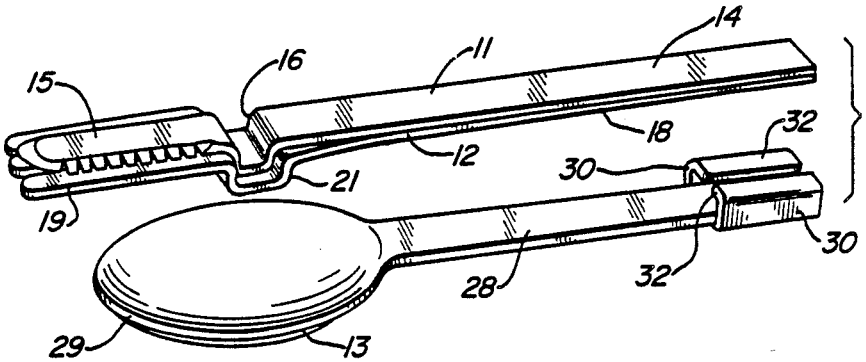
FIG. 3
FIG. 4
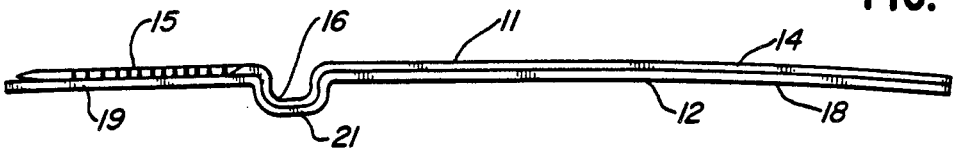
FIG. 5
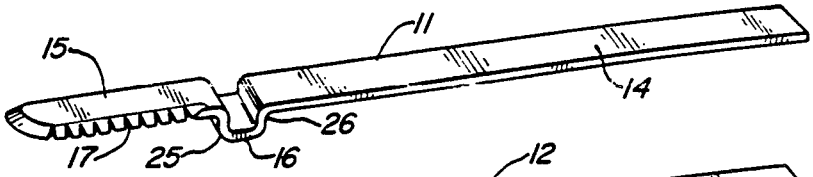
FIG. 6
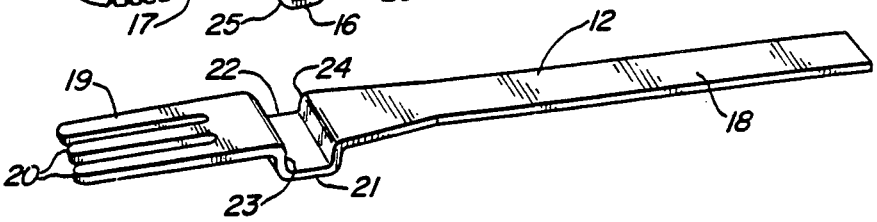

NESTING FLATWARE SET

BACKGROUND AND SUMMARY

This invention relates to a nesting flatware set which is particularly suitable for camping and backpacking.

As used herein, the term "flatware" includes eating utensils of various kinds, particularly, knives, forks, and spoons. It is frequently desirable to use flatware which can interfit together or nest. For example, nesting flatware is particularly advantageous for campers or backpackers who need to conserve storage space.

The invention provides a nesting flatware set comprising a knife, fork, and spoon which can be interfitted together and releasably locked so that the flatware is retained in a compact configuration. The nesting flatware occupies a minimal amount of space, and the nesting set is less likely to become misplaced than individual pieces. When the pieces are nested, the knife edge is shielded by the other pieces to protect against accidental cutting.

DESCRIPTION OF THE DRAWING

The invention will be explained in conjunction with an illustrative embodiment shown in the accompanying drawing, in which FIG. 1 is a perspective view of a nesting flatware set in accordance with the invention;

FIG. 2 is a sectional view taken along the line 2—2 of FIG. 1;

FIG. 3 is a perspective view showing the knife and fork separated from the spoon;

FIG. 4 is a side elevational view of the knife and fork; and

FIG. 5 is perspective view showing the knife and fork separated.

DESCRIPTION OF SPECIFIC EMBODIMENT

A flatware set 10 includes a knife 11, a fork 12, and a spoon 13. However, the flatware set could also include other utensils.

The knife 11 includes an elongated generally flat handle portion 14, a generally flat blade portion 15, and a generally U-shaped intermediate locking portion 16. The blade portion includes a serrated cutting edge 17.

The fork 12 includes a generally flat handle portion 18, a tine portion 19 which includes a plurality of tines 20, and a generally U-shaped intermediate locking portion 21.

The locking portion 21 of the fork forms a generally dovetail-shaped slot 22 which has a U-shaped trough 23 and a narrowed mouth 24. The locking portion 16 of the knife forms a mating dovetail-shaped projection which includes a head portion 25 and narrowed shoulder portions 26. The head portion 25 of the knife is slightly wider than the mouth 24 of the fork and can be received snugly within the trough 23 of the fork.

The knife and fork are nested together by pushing the head portion 25 past the narrow mouth 24 and into the trough 23. Alternatively, the head can be pushed sideways into the trough from one side of the fork. The knife and fork are made from flexible and resilient metal, for example, stainless steel, and the locking portions can deform slightly to permit the head to pass the mouth.

The spoon 13 includes an elongated generally flat handle portion 28 and a bowl portion 29. A pair of C-shaped locking flanges 30 extend upwardly from the sides of the bottom end of the handle, and a stop flange 31 extends upwardly from the bottom edge of the handle. The locking flanges include a pair of generally flat shoulder portions 32 which are spaced from the handle 28 slightly more than the total thickness of the handles 14 and 18 of the knife and fork. The locking flanges 30 and stop flange 31 are advantageously formed integrally with the handle 28 and are bent into their final shape.

Referring to FIG. 4, the handle portion 18 of the fork and the tine portion 19 are inclined slightly relative to each other so that they are not parallel and form an included angle of slightly less than 180°. The handle portion 14 of the knife and the blade portion 15 are also slightly inclined and form an included angle of less than 180°. Alternatively, the handles 14 and 18 could be slightly curved so that the top ends of the knife and fork provided by the blade and the tines are slightly below the bottom ends of the handles when the handles are held horizontal.

After the knife and fork are nested together, the handles 14 and 18 of the knife and fork are inserted between the handle 28 of the spoon and the locking shoulders 32 until the bottom ends of the knife and fork abut the stop flange 31. The locking shoulders 32 hold the handle portions 14 and 18 relatively snugly and generally parallel with the handle portion 28 of the spoon. Because the tine portion 19 of the fork extends slightly angularly with respect to the handle portion 18, the tine portion will bear against the top tip of the bowl 29 of the spoon, and the fork will be frictionally retained against the spoon. The dovetail locking portion 21 of the fork is located approximately in the middle of the bowl and does not interfere with the frictional retention force. The flexible and resilient metal of the knife and fork permit the knife and fork to be deformed slightly as their handle ends are inserted below the locking shoulders 32. When the knife and fork are released, the tine portion of the fork will move into engagement with the bowl of the spoon.

When the flatware set is nested together as illustrated in FIG. 1, the locking portions 16 and 21 of the knife and fork provide a frictional locking force between the knife and fork. Additional frictional locking force is provided between the bottom ends of the knife and fork by the locking shoulders 32 of the spoon which force the bottom ends of the knife and fork against the handle 28 of the spoon. The fork is frictionally locked relative to the spoon by the forces at the top and bottom of the fork which are provided by the angular relationship between the top and bottom of the fork and by the locking shoulders 32 which force the bottom end of the fork against the handle 28 of the spoon.

The blade portion 15 of the knife is narrower than the tine portion 19 of the fork, and the sharpened edge 17 of the knife is spaced inwardly from the outside of the tines. The tines thereby provide an edge guard which protects the knife edge and which prevents accidental cutting.

If desired, the position of the knife and fork can be reversed so that the knife is between the fork and the spoon. In that event, the locking portion of the fork is sized to fit into the locking portion of the knife.

The flatware set can be easily disassembled simply by lifting the top ends of the knife and fork away from the bowl of the spoon and withdrawing the bottom ends of the knife and fork from the space between the locking shoulders 32 and the handle 28 of the spoon. Thereafter, the knife and fork can be separated by withdrawing the locking portion 16 of the knife from the locking portion 21 of the fork.

Although the nesting flatware set described includes three utensils -- a knife, a fork, and a spoon, the nesting flatware set could include only two utensils. For example, two utensils such as the knife and fork could be frictionally retained by a dovetail projection 16 and a dovetail slot 21. Alternatively, two utensils such as the fork and spoon could nest together and be frictionally retained by the locking shoulders 32 and the angular relationship between the end portions of the fork. In that event, the spacing between the locking shoulders 32 and the handle 28 would be reduced so that the handle of the fork is retained relatively snugly between the locking shoulders 32 and the handle of the spoon.

While in the foregoing specification a detailed description of a specific embodiment of the invention was set forth for the purpose of illustration, it will be understood that many of the details herein given may be varied considerably by those skilled in the art without departing from the spirit and scope of the invention.

I claim:

1. A nesting flatware set comprising a pair of eating utensils, each of the utensils having a pair of end portions and an intermediate locking portion, the intermediate locking portion of one of the utensils having a dovetail slot and the intermediate locking portion of the other utensil having a dovetail projection sized to be frictionally retained within the dovetail slot whereby the utensils are releasably retained together.

2. The flatware set of claim 1 in which one of the utensils is a knife and one of the end portions of the knife provides a handle and the other end portion provides a cutting edge.

3. The flatware set of claim 2 in which the other of the utensils is a fork and one of the end portions of the fork provides a handle and the other end portion of the fork includes a plurality of tines.

4. The flatware set of claim 3 in which each of the end portions of both the knife and fork are substantially flat and bear against each other when the knife and fork are releasably retained together.

5. The flatware set of claim 1 in which one of the utensils is a fork and one of the end portions of the fork provides a handle and the other end portion provides a plurality of tines.

6. A nesting flatware set comprising a spoon, a knife, and a fork, the spoon having a first end portion providing a handle and a second end portion providing a bowl, the fork having a first end portion providing a handle, a second end portion providing a plurality of tines, and an intermediate portion between the handle and the tines, the knife having a first end portion providing a handle, a second end portion providing a cutting edge, and an intermediate portion, the intermediate portion of one of said fork and knife having a dovetail slot, the intermediate portion of the other of said fork and knife having a dovetail projection sized to be frictionally retained within the dovetail slot whereby the knife and fork are releasably retained together, and locking means on the first end portion of the spoon for frictionally retaining the first end portions of the knife and fork.

7. The flatware set of claim 6 in which said dovetail slot and dovetail projection are positioned in the bowl of the spoon when the knife and fork are retained by said locking means.

8. The flatware set of claim 6 in which the first and second end portions of one of said fork and knife form an included angle of less than 180° so that the second end portion is forced against the bowl of the spoon when the knife and fork are retained by said locking means.

9. The flatware set of claim 8 in which the first and second end portions of each of the knife and fork form an included angle of less than 180°.

10. The flatware set of claim 6 in which the first end portions of the spoon, knife, and fork are substantially flat and the locking means on the spoon includes a pair of shoulders spaced from the flat end portion of the spoon whereby the flat end portions of the knife and fork can be inserted between said shoulders and the flat end portion of the spoon.

11. The flatware set of claim 6 in which said dovetail slot is formed by a generally U-shaped bend in the associated intermediate portion and said dovetail projection is formed by a generally U-shaped bend in the associated intermediate portion.

* * * * *